US005624593A

United States Patent [19]

Martens

[11] Patent Number: 5,624,593

[45] Date of Patent: Apr. 29, 1997

[54] YARN ADVANCING HEATED GODET HAVING TEMPERATURE CONTROLLING SENSORS

[75] Inventor: Gerhard Martens, Remscheid, Germany

[73] Assignee: Barmag AG, Remscheid, Germany

[21] Appl. No.: 406,977

[22] PCT Filed: Sep. 28, 1993

[86] PCT No.: PCT/EP93/02629

§ 371 Date: May 30, 1995

§ 102(e) Date: May 30, 1995

[87] PCT Pub. No.: WO94/08080

PCT Pub. Date: Apr. 14, 1994

[30] Foreign Application Priority Data

Oct. 1, 1992 [DE] Germany ..... 42 32 967.1
Mar. 23, 1993 [DE] Germany ..... 42 09 281.0

[51] Int. Cl.[6] ..... H05B 6/14

[52] U.S. Cl. ..... 219/619; 219/667; 219/470; 219/516; 219/471

[58] Field of Search ..... 219/619, 667, 219/469, 470, 471, 494, 516

[56] References Cited

U.S. PATENT DOCUMENTS 3,286,081 11/1966 Scowcroft .
3,581,060 5/1971 Bauer et al. .
3,879,594 4/1975 Shillito ..... 219/619
4,533,808 8/1985 Newman ..... 219/619
5,142,280 8/1992 Lehle .
5,362,945 11/1994 Baader ..... 219/619

FOREIGN PATENT DOCUMENTS 0511549 11/1992 European Pat. Off. .
1955938 6/1970 Germany .
3830384 3/1990 Germany .
1180684 2/1970 United Kingdom .

*Primary Examiner*—Philip H. Leung
*Attorney, Agent, or Firm*—Bell, Seltzer, Park & Gibson, P.A.

[57] ABSTRACT

Described is a godet (2) for guiding and advancing endless filament yarns, which comprises one or several heating zones along its casing (3), the heat that is applied by the heating elements (7–10) to the godet casing (3) being scanned by a multiple temperature sensor (12), so as to control the temperature of godet casing (3) in zones. In accordance with the invention, the temperature sensor (12) consists of a flat circuit arrangement of resistors and conduction bands, which are enclosed by a coating resistant to even high temperatures. The exposed tapping contacts (18) lead to the outside of godet (2) and are connected, via measuring lines, with an evaluation unit, whereas the temperature sensor (12) itself is attached to the inside surface of the rotatably driven godet casing (3).

6 Claims, 2 Drawing Sheets

YARN ADVANCING HEATED GODET HAVING TEMPERATURE CONTROLLING SENSORS

BACKGROUND OF THE INVENTION

The present invention relates to a godet of the type disclosed in U.S. Pat. No. 3,581,060.

In known heated godets, which are normally constructed according to the design described in U.S. Pat. No. 3,581,060, the temperature sensors in the form of thin bars, are inserted into the godet casing parallel to the axis of rotation. This entailed, in particular in the case of godets with several heating zones, that it was necessary provide in the godet jacket, starting from its front end and distributed over its circumference, a number of bores of different depth corresponding to the number of heating zones, which resulted, in particular in the case of godets rotating at high speeds, not only in a considerable weakening of the godet casing, but also in unbalances which were complicated to remove.

Known from DE-A 1 955 938 is a draw roll for advancing a yarn with a rotatable casing having one heated zone. Arranged in the interior of the casing is a stationary heating element. A flat temperature sensor is located on the heating element. The heating element and the temperature sensor are separated by an insulating cover.

The temperature sensor is arranged on the heating element facing the inside surface of the casing. The spacing between the temperature sensor and the inside surface of the casing is from about 0.3 to 1 mm. The air gap should correspond to about the boundary-layer thickness of the air, since it allows to maintain the most direct heat transfer.

In the embodiment of DE-A 1 955 938, the temperature of the casing is measured indirectly, since there is an air gap between the temperature sensor and the casing.

This measuring technique has also the disadvantage that a temperature fluctuation is registered, which does not occur necessarily also on the casing, since the temperature gradient in the air gap is dependent on the width of the air gap.

Conditioned both by manufacturing tolerances and by natural wear, the air gap may vary. To maintain a constant air gap, it is necessary to minimize manufacturing tolerances and a possible wear. This again results in that the manufacturing costs of a godet increase accordingly.

Having in mind the foregoing disadvantages, it is the object of the invention to achieve a satisfactory temperature measurement of the godet casing.

SUMMARY OF THE INVENTION

To accomplish this object, it is proposed to arrange the temperature sensor on the inside surface of the godet casing, in particular parallel to the godet shaft. The temperature sensor is a measuring arrangement enclosed by an insulating cover with exposed tapping contacts leading outward via conduction paths.

This measure permits to eliminate the costly machining of the godet casing that is required in the state of the art. Essential however is in addition that the temperature sensors of a godet as used in accordance with the invention and designed to conform to the curvature of the godet casing and to rest thereagainst without interspace, have in all temperature measuring zones the same distance from the axis of rotation. As a result, the temperature gradient with respect to the yarn contact surface of the godet casing is or can be the same in all temperature sensors. The attachment to the inside surface of the godet casing is to be such as to cover the entire area. An attachment by gluing or clamping has shown to be suitable therefor.

Over their length, heated godets are subdivided mostly into several heating zones, in particular when they have a large overall length. In accordance with the invention, it is possible to associate over the circumference of the godet each heating zone with its own temperature sensor or, however, to scan all heating zones with a common multiple temperature sensor, the measuring ranges of this temperature sensor being distributed over the godet length in accordance with the several heating zones.

In particular in the latter instance, it may be useful to subdivide the temperature sensor in the axial direction into several identical, if need be, even interconnected measuring ranges, each having its associated tap, which are assigned to the heating zones of the godet. Suitably, the taps are combined at one end of the sensor strip and connected by conduction paths with their associated measuring ranges.

Likewise, it is possible to divide the temperature sensor strip extending over the length of the godet casing into a number of independent temperature sensors, which is equal to the number of heating zones of the godet casing, each temperature sensor having its own measuring line.

In one embodiment, the measuring taps of the temperature sensor or sensors, which rotate along with the godet casing, are distributed over the circumference of a circle. Associated to them is, for example a scanner, which is held in its position at the front end of a hollow, stationary carrier, and which itself is equipped with tap contacts. The carrier extends from the bearing side of the godet through a center bore of the godet shaft to the front end of the godet, and carries the measuring lines, which connect the tapping contacts with an electronic evaluation unit.

Such a mechanical scanning is used in essence exclusively for low rotational speeds.

As an alternative, a noncontacting transmission of the values measured on the godet casing is provided, such as is known in principle from DE 38 30 384 A or corresponding U.S. Pat. No. 5,142,280.

DETAILED DESCRIPTION OF THE PREFERRED EMBODIMENT

Figure 1:
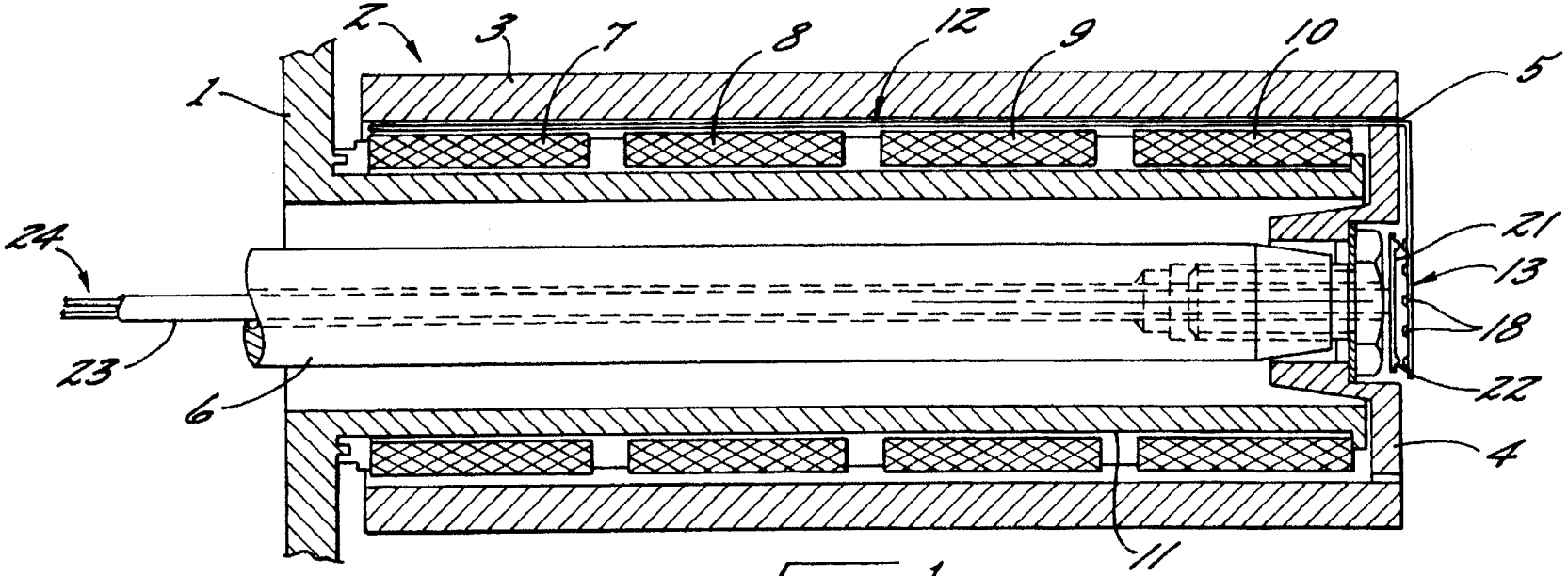
FIG. 1 is an axial sectional view of the godet in accordance with the invention with a common multiple temperature sensor.

Referring more particularly to the drawings, a heated godet which embodies the present invention is indicated generally at 2. The godet 2 includes a godet casing 3, which is mounted, in the usual.

The godet casing 3 is secured, in the usual manner, via front end wall 4 of the godet, for rotation with godet shaft 6. In concentric relationship with godet shaft 6, a tubular holder 11 attached to machine frame 1 extends close to front end wall 4 of the godet, however, without contacting same. Arranged on holder 11 are annular heating elements 7–10, for example, induction coils. They are supplied with current in a manner not shown in more detail.

Attached or, preferably, glued flat to the inside wall of godet casing 3 is a temperature sensor 12 extending along an axis parallel thereto. Same is common to all heaters 7–10 and divided into corresponding sections (note FIG. 2). The temperature sensor 12 extends from the outside of front end wall 4 through, for example, slot-shaped apertures 5 provided in front end wall 4, into the interior of the godet casing. A portion 13 of temperature sensor 12 carrying the tapping contacts extends on the outside of front end wall 4 toward its center. Its layout and function will be described further below.

Figure 2:
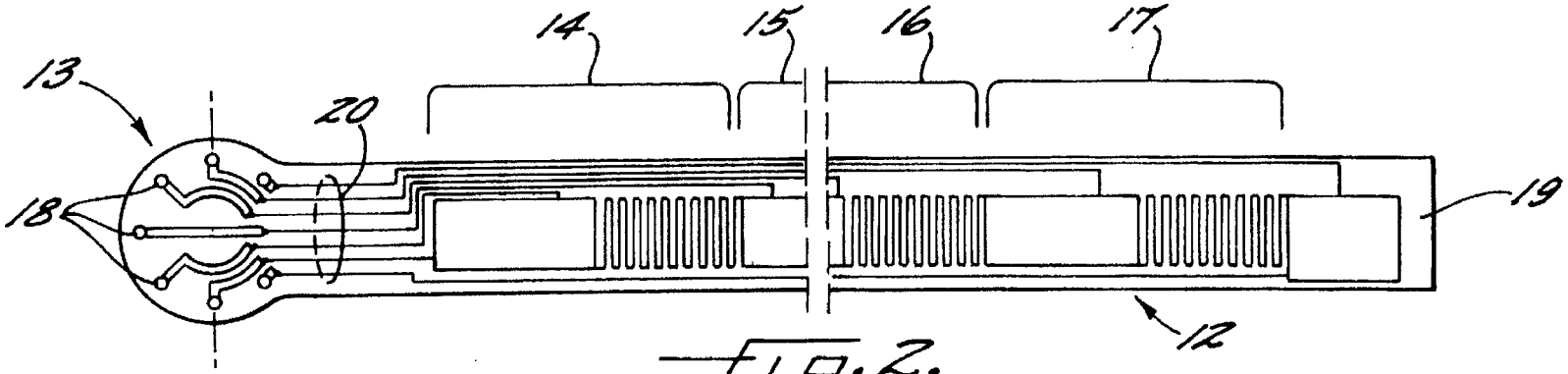
FIG. 2 is a diagrammatic view of a temperature sensor strip.

FIG. 2 illustrates an embodiment of the temperature sensor 12 used in accordance with the invention. It is subdivided into individual measuring sections—that is into four measuring sections 14–17 in adaptation to the godet shown in FIG. 1 with four heating zones 7–10—which are connected via conduction paths 20 with tapping contacts 18 arranged on contact disk 13. The entire circuit arrangement is provided on both sides with a cover, for example, with a coating 19 which leaves exposed only tapping contacts 18. Preferably, the coating consists of polyamide. It may also consist, for example, of a base coating of fiber glass silicon rubber with a surface coating of polyamide, silicate fiber embedded in a ceramic coating, or a different material or combination of materials, provided same is resistant to the process-required godet temperatures of, for example, 250° C. to 350° C. The temperature measuring sections 14–17 may, for example, comprise thermocouple chains, formed of a temperature resistant material, such as PT100.

In the embodiment of FIG. 1, the contact disk 13 is arranged such that, during the rotation of godet casing 3, all tapping contacts 18 rotate along a circle concentric to godet shaft 6.

The godet shaft 6 is constructed as a hollow shaft and has a coaxial longitudinal bore, which continues in a mounting screw not shown in detail and terminates in its head. Through the hollow shaft, a hollow carrier 23 extends, for example, a protective tube or conduit, which is attached to the machine frame, the front end of which carries a disk-shaped scanner 21 extending in a normal plane relative to the godet axis. The surface of scanner 21 facing contact disk 13 is provided with at least one, preferably two or more scanning elements 22, which are connected each individually via measuring lines 24 with an evaluation unit not shown.

Figure 3:
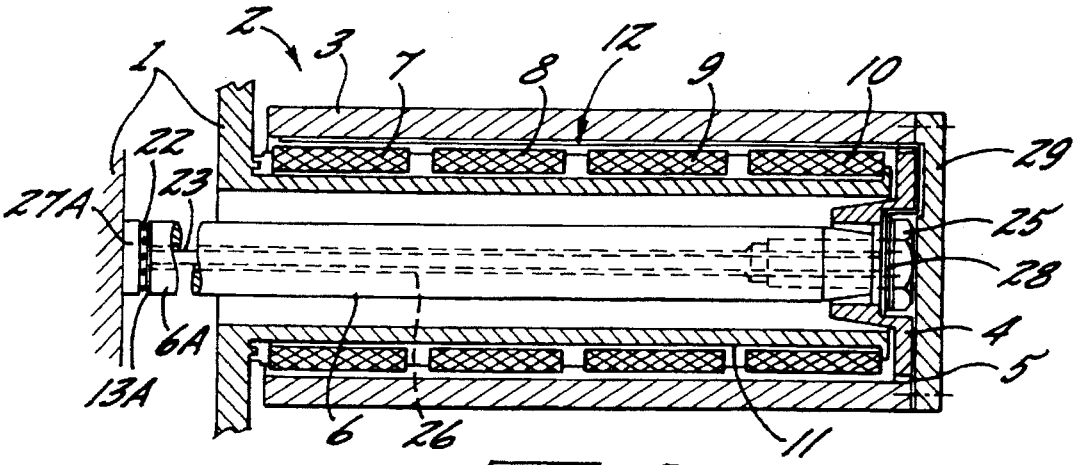
FIG. 3 is an axial sectional view of a further embodiment of the godet.
Figure 3A:
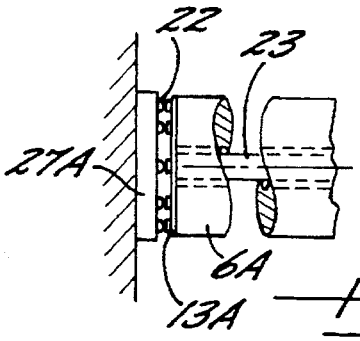
FIG. 3A is an enlarged cutout view of FIG. 3.

Shown in FIGS. 3 and 3A is a further embodiment of godet 2 in accordance with the invention with a temperature sensor 12, which is divided into individual measuring sections assigned to the individual heaters 7–10. Their layout corresponds substantially to the above described embodiment shown in FIG. 1. However, the transmission of the signals received by temperature sensor 12 and its measuring sections 14–17 is carried out in a different manner.

The temperature sensor 12 leading in like manner as in the embodiment of FIG. 1 with its portion 13 carrying tapping contacts be to godet shaft 6 (see FIG. 1), is clamped in the embodiment of FIG. 3 by means of a hollow screw 25 together with a counterpiece, so that its contacts coincide with corresponding mating contacts on the counterpiece. In FIG. 3, this counterpiece is shown together with portion 13 as a contact unit 28 and forms the end piece of the stranded measuring line 24 extending in protective tube 23 (FIG. 1). In the present embodiment, the stranded measuring line terminates at the rearward shaft end 6A (note, in particular FIG. 3A), in a disk 13A secured to the rearward shaft end surface and carrying tapping contacts 22. Arranged opposite thereto is a scanner 27A connected to machine frame 1, which forms a part of a transducer 27, which is described further below. Protective tube 23, stranded measuring line 24, and contact disks 13A, 28 rotate together with godet casing 3 and front end godet cover 29, whereas holder 11 projecting from machine frame 1 and heaters 7–10 mounted thereon are stationary. The godet shaft 6 is supported and driven in known manner, which is therefore not shown in detail.

Figure 4:
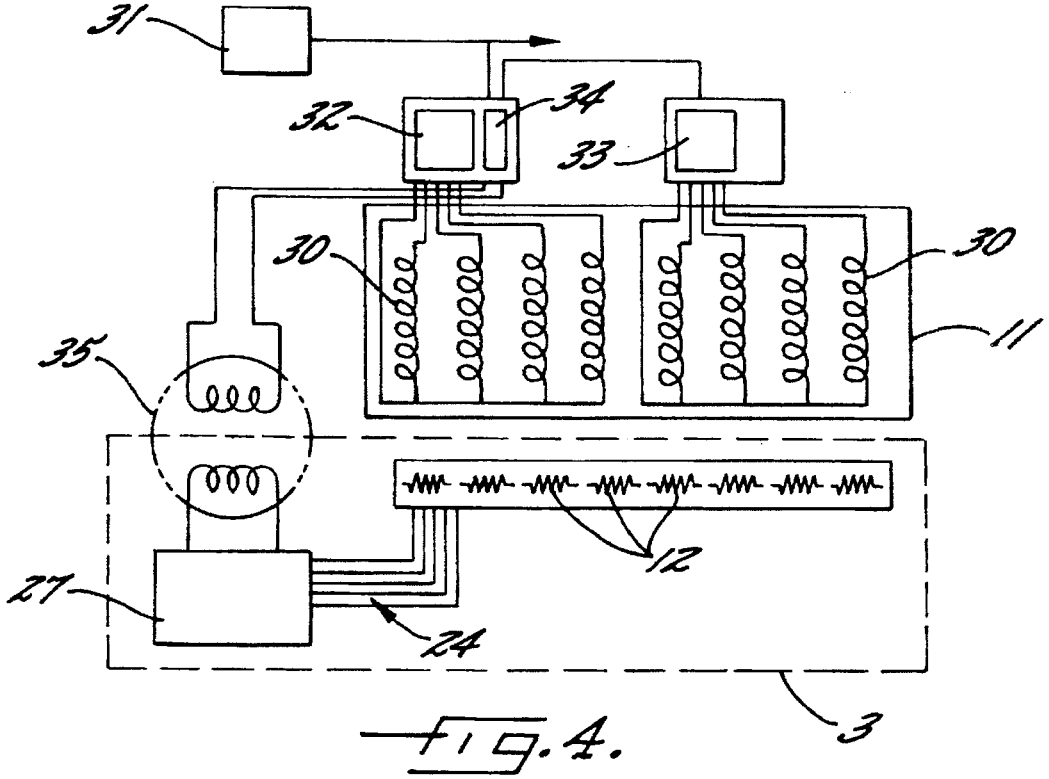
FIG. 4 is a circuit diagram of a godet heating system in accordance with the invention.

The operation of the above-described embodiments is described in more detail with reference to the circuit diagram of FIG. 4. However, it should be noted that same represents only one of the possibilities.

The selection of the program being run occurs by a corresponding programming in a central control unit 31. Induction coils 30 receive from high-frequency supply units 32, 33 a base load corresponding to this program. The temperature sensors 12 or the individual measuring sections of multiple temperature sensor 12 generate signals corresponding to the godet temperatures, which reach, via stranded lines 24, a transducer 27, where they are converted to digital signals, and whence they are transmitted via a data transmitter 35 to a temperature control 34. In this unit, the actual values are compared with desired values input by central control unit 31, and corresponding correction signals are generated. The high-frequency supply units 32, 33 receive correcting signals, which are obtained from the comparison between actual and desired values, and the energy supply to induction coils 30 is modified accordingly.

It should be expressly stated that the invention is not limited to the use of a temperature sensor 12 as illustrated in FIG. 2. Same represents only an exemplary form. Likewise, the embodiment of transmitting measured values from the rotating portion of the godet to the stationary portion of the machine frame is not intended to limit the invention in any manner. Rather, other solutions are feasible, which are familiar to the person of the art, who deals with such measuring technological problems, or which are described in the technical literature.

I claim:

1. A godet for guiding and advancing a yarn and comprising a godet casing (3) mounted to a support frame for rotation about a central axis, with said godet casing having a hollow interior which includes a cylindrical inside wall which coaxially surrounds and faces said central axis, a plurality of stationary and axially spaced apart heating elements (7–10) mounted to said support frame so as to be positioned within the hollow interior of said godet casing and immediately adjacent the inside wall thereof, and a plurality of axially spaced apart temperature sensors (14–17) mounted to the inside wall of the godet casing so as to be adjacent respective ones of said heating elements, the temperature sensors each being in the form of a flat temperature measuring unit which is mounted to the inside wall of the godet casing, and with the temperature sensors being supported in a unitary elongate strip, such that the sensors are axially aligned, and wherein the unitary strip includes a coating (19) of an insulating material, and further including exposed tapping contacts (18) connected to respective sensors via conduction lines (20).

2. The godet as defined in claim 1 wherein said tapping contacts are mounted on a common disk (13).

3. The godet as defined in claim 2 wherein the tapping contacts are arranged in a circle which coaxially surrounds the central axis, and further comprising a scanner (21) mounting scanning elements (22) which are positioned in association with the tapping contacts, with the scanner being connected via lines (24) to an evaluation unit (27, 34).

4. The godet as defined in claim 1 wherein said coating comprising polyamide.

5. The godet as defined in claim 1 wherein said coating comprises a base coating of fiberglass silicon rubber and a surface coating of polyamide.

6. The godet as defined in claim 1 wherein said sensors comprise thermocouple chains.

* * * * *